United States Patent [19]

McNeill

[11] 4,448,418

[45] May 15, 1984

[54] SURFACE PROJECTILE AND TARGET GAME

[76] Inventor: Locksley D. McNeill, 584 Ash St., Winnipeg, Manitoba, Canada, R3N 0R4

[21] Appl. No.: 415,168

[22] Filed: Sep. 7, 1982

[30] Foreign Application Priority Data

Sep. 24, 1981 [GB] United Kingdom ..... 8128847

[51] Int. Cl.[3] ..... A63B 63/00; A63B 43/04

[52] U.S. Cl. ..... 273/123 A; 273/58 H; 273/58 F; 46/211

[58] Field of Search ..... 273/58 F, 115, 345, 273/58 H, 123 R, 398, 400, 118 R, 123 A, 124 R, 124 A, 125 R, 125 A, 127 R

[56] References Cited

U.S. PATENT DOCUMENTS

| | | | |
|---|---|---|---|
| 823,049 | 6/1906 | Kelly | 273/352 |
| 1,503,415 | 7/1924 | Fohmann | 273/123 R |
| 1,604,846 | 10/1926 | Nelson | 273/118 R |
| 1,991,671 | 2/1935 | Hodson | 273/58 F |
| 2,457,421 | 12/1948 | Warren | 273/345 X |
| 2,670,206 | 2/1954 | Brewster | 273/58 H X |
| 3,399,894 | 9/1968 | Smith | 273/115 |
| 3,625,514 | 12/1971 | Carsten | 273/345 X |
| 3,655,197 | 4/1972 | Milbaum | 273/58 F X |
| 3,734,498 | 5/1973 | Seiersen | 273/58 F X |
| 3,954,269 | 5/1976 | Brittingham | 273/58 F X |
| 4,019,739 | 4/1977 | Waite | 273/123 R |
| 4,194,737 | 3/1980 | Farmer | 273/58 F X |
| 4,331,335 | 5/1982 | Starkweather | 273/345 |

*Primary Examiner*—George J. Marlo

*Attorney, Agent, or Firm*—Stanley G. Ade

[57] ABSTRACT

Balls with lead or steel shot, weights, liquid or the like are pitched or rolled towards a board such as a crokinole or naughts and crosses board and remain relatively stationary once they have landed. The board is upwardly inclined and contains dividers extending upwardly therefrom in both the transverse and lengthwise directions of the board. The balls may have a fixed weight so that wires can be applied when rolling such as required for a lawn bowling type game. When used with steel shot or the like, they can be played onto a magnetized board which will hold them in place or alternatively, a flexible fabric or plastic bag type ball can include steel shot or the like and can be pitched onto a magnetized board. The balls constructed in accordance with this invention can be used for any game which utilizes a ball.

11 Claims, 13 Drawing Figures

| | | |
|---|---|---|
| 3 | 3 | 3 |
| 2 | 4 | 2 |
| 1 | 1 | 1 |

| | | |
|---|---|---|
| A | B | C |
| D | E | F |
| G | H | I |

| | | |
|---|---|---|
| 4 | 4 | 4 |
| 3 | 3 | 3 |
| 2 | 2 | 2 |

SURFACE PROJECTILE AND TARGET GAME

BACKGROUND OF THE INVENTION

This invention relates to new and useful improvements in playing balls and games therefore, particularly balls and games designed primarily for use in the field of geriatrics in order to assist in providing physical and social activities to elderly people.

They can be used also for physically and mentally handicapped people, people who require occupational therapy, children and can also be used in the recreation room of any home or club, or outdoors, depending upon circumstances.

Conventional balls such as tennis balls, rubber balls and the like, although relatively lightweight, can be hit or thrown a considerable distance which requires much effort for elderly or handicapped personnel.

SUMMARY OF THE INVENTION

The present invention overcomes these disadvantages by providing a ball which behaves in a different manner from a conventional ball upon being rolled, tossed, kicked, batted, thrown by hand or thrown by a mechanical device.

The ball has as a principal characteristic thereof, the ability to quickly come to a stable position and remain in a state of relative stability after it has been propelled by any of the above methods. In addition, a further embodiment of the ball can be used for certain games where the ball is rolled on an even textured surface in a straight, a right or a left hand curving path.

A further advantage of the ball is that it can be manufactured in any size or weight desired, depending upon the game being played.

In accordance with the invention there is provided a ball for rolling, pitching and the like comprising an outer enclosing envelope and a weighted element against one portion of the inner wall of said envelope for shifting the centre of gravity of the ball from the centre thereof.

In accordance with another aspect of the invention a playing board may be used for use with the ball as defined, said board including a base, means supporting said base at an inclined angle from the horizontal, said base extending upwardly and rearwardly from the front edge thereof, a plurality of dividers extending upwardly from the upper surface of said base thereby defining a plurality of compartments, said compartments adapted to receive said ball.

Another advantage of the invention is to provide a ball of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention in which:

DESCRIPTION OF THE DRAWINGS

In the drawings like characters of reference indicate corresponding parts in the different figures.

DETAILED DESCRIPTION

Figure 1:
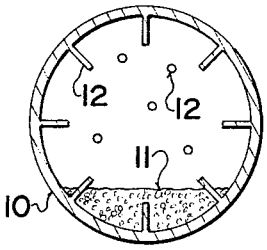
FIG. 1 is a cross sectional view of one embodiment of the ball.

The ball used for most games consists of a hollow spherical rubber ball or enclosing envelope which may be made of vulcanized rubber or may be finished such as a tennis ball and is illustrated in the accompanying drawings by reference character 10. In the embodiment shown in FIG. 1, a quantity of lead shot or other fluent material 11 is placed within the hollow ball as illustrated in FIG. 1. Instead of lead shot, mercury, iron filings, liquid, pebbles or the like may be utilized. However, lead shot is preferable for most purposes and of course the lead shot should be comprised of smooth spherical pellets which will flow smoothly within the ball when the ball is rotated. To further enhance the smooth flow of the shot within the ball when rotated, a quantity of light oil may be added.

Further control of the ball when rotated, may be controlled by the provision of a plurality of evenly distributed obstructions such as pins 12 extending inwardly from the inner surface of the ball or other such obstructions may be used. It can readily be seen that when the ball is propelled, once it strikes the ground, it rapidly approaches a stable condition and remains in that condition. This means that the ball can be thrown, pitched or tossed and as soon as it lands, the distance travelled will be extremely limited thus making it particularly applicable for use indoors. The ball preferably should contain air or any other inert gas, under sufficient pressure to maintain its spherical shape when rolled on a relatively even surface such as a floor, a carpeted floor or a bowling green.

Although a ball such as a hollow rubber ball is illustrated, nevertheless other balls may be constructed utilizing a similar principle.

For example, in the game of billiards, a very smooth rolling ball is required and such a ball may be made by using a metal or plastic ball with a smooth spherical surface on the outside and a quantity of liquid mercury on the inside. As hereinbefore described, the slowing down effect of the mercury may be increased by providing on the inner surface of the ball, a uniform pattern of the obstacles to decrease the speed of flow. Such obstacles also permit the use of a fluid such as water or oil.

Figure 3:
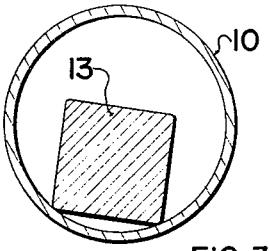
FIG. 3 is a cross sectional view of an alternative embodiment.

Alternatively, a solid die 13 may be loosely enclosed within the ball 10 as illustrated in FIG. 3 or a smaller solid ball having ten or more flat surfaces. While such a ball will not roll as smoothly as the ball illustrated in FIG. 1, nevertheless it can be used under certain conditions.

Figure 2:
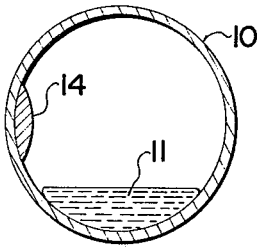
FIG. 2 is a cross sectional view of an alternative embodiment showing the ball in position to be rolled with a left hand curve.
Figure 2A:
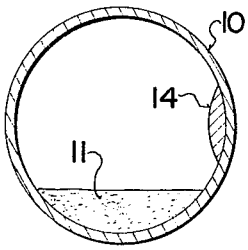
FIG. 2A is a view similar to FIG. 2, but showing the ball in a position to be rolled with a right hand curve.

FIGS. 2 and 2A show a ball similar to that illustrated in FIG. 1 with the exception that a small fixed weight 14 is provided on the inner surface of the ball at a specific location as clearly illustrated.

This smooth flat weight is fastened in a permanent position and should be of such shape as to present the minimum of interference to the smooth flow of the material 11 within the ball, when the ball is rotated.

From the foregoing it can readily be seen that when the ball is rolled from the hand with a fixed weight at the apex of the ball, it will tend to pursue a straight course. When rolled with the fixed weight on the left side as illustrated in FIG. 2, it will tend to pursue a path curving to the left of the player. Conversely, when rolled with the fixed weight on the right hand side as shown in FIG. 2A, it will tend to pursue a path curving to the right.

The aforementioned balls may be adapted for use in many ordinary games such as ground hockey, baseball, soccer, lawn bowling, carpet bowling, billiards, snooker and the like and bowling. A home practice ball for five pin or ten pin bowlers could be used either of the same or a smaller size and the accepted weight could be achieved by placing the required weight of metal shot, sand or other material within the hollow ball.

It will also be noted that the ball illustrated in FIG. 1 can be thrown against any available wall without likely injury to the wall and with the air pressure at suitable levels, should return to the person throwing the ball.

In ground hockey and soccer, this new ball would means less running after the ball and more skill in passing. It would make for more skill and less endurance and would prolong the playing life of highly skilled players. Furthermore, it would also be suitable to the capacities of all the players.

In cricket, this new ball would greatly reduce the time consumed in running after balls which are not caught and the effect obtained by a competent bowler might well produce a very novel and more interesting game of cricket.

Figure 4:
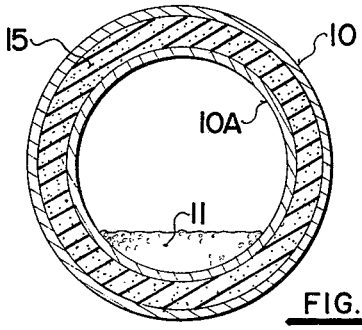
FIG. 4 is a cross sectional view of a yet further embodiment.

If used in playing soccer, the impact of the weight inside the ball, should the ball strike the head or other vulnerable part of the player's body, might cause some injury. To provide for this possibility, reference should be made to FIG. 4 which shows the outer ball 10 together with an inner ball carrying the fluent material 11 and separated from the outer ball by means of a layer of sponge rubber 15 which may be applied as a covering to the inner ball.

Figure 5:
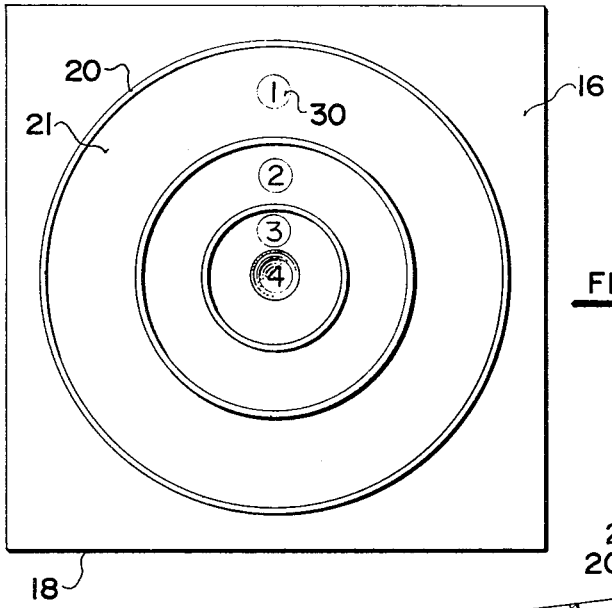
FIG. 5 is a plan view of a board with which the ball can be used.
Figure 6:
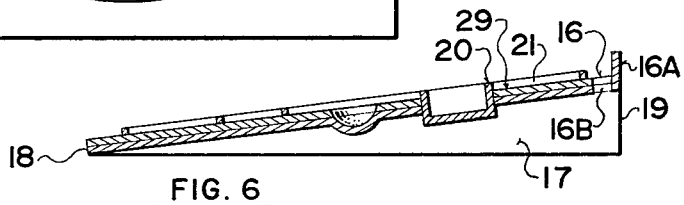
FIG. 6 is a cross sectional side elevation of FIG. 5.

Reference to FIGS. 5 and 6 show one type of game which is particularly suitable for use with a ball of the type illustrated and described in FIG. 1.

It is a form of crokinole and may be played by one or more persons.

The playing board is a rectangular board 16 and preferably square. A base 17 extends rearwardly from the front edge 18 of the board 16 and a rear wall 19 permits the upper board 16 to present an inclined surface when placed on a relatively flat surface.

A plurality of concentric rings 20 are secured to the surface of the board 16 and extend upwardly therefrom as shown in FIG. 6 thus defining annular channels 21.

The game is played by rolling a ball such as that illustrated in FIG. 1, by hand onto the playing board from a prescribed distance. It will be appreciated that the upper surfaces of the rings 20 are only just proud of the surface of the board 16 so that they permit the balls to be rolled across the rings and into the annular spaces and as the rings vary in circumference, the smaller rings can carry a larger score as illustrated.

Figure 7:
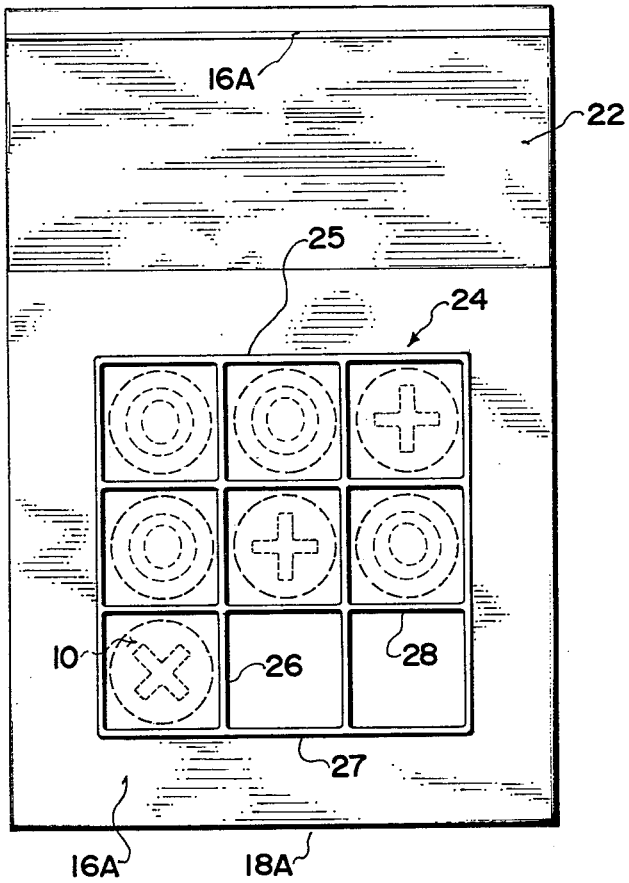
FIG. 7 is a plan view of a board of a further game with which the ball can be used.
Figure 8:
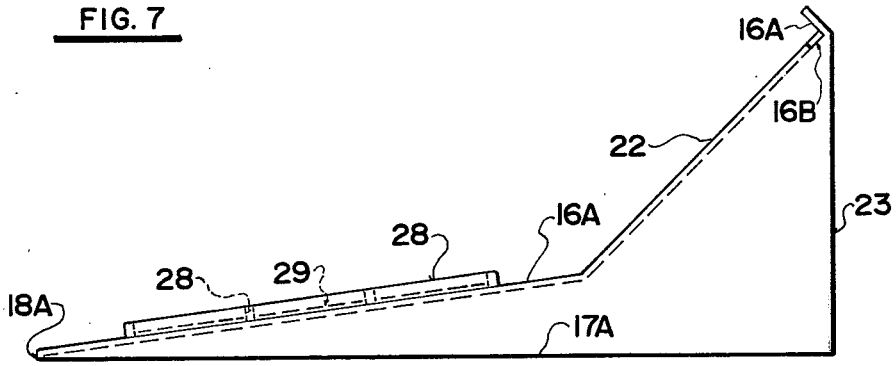
FIG. 8 is a side elevation of FIG. 7.

FIGS. 7 and 8 show a similar type board inasmuch as a base 17A is provided with an inclined upper surface 16A extending rearwardly from the front edge 18A. A more steeply inclined backboard 22 is provided supported by rear wall 23, all of which is clearly illustrated.

A "Naughts and Crosses" board or configuration collectively designated 24 is formed upon the upper surface 16A by the provision of a grid pattern 25 formed by strips 26 and other strips 27 perpendicular thereto with the upper edges 28 raised above the surface of the board 16A.

The dividers or partitions define nine equal squares, the dimensions of which are just slightly larger than the diameter of the balls. This enables the balls to be tossed or rolled onto the board with the object being similar to that of the conventional game. The more steeply inclined backboard 22 permits a ball passing over the grid to roll back down the incline and come to rest in one of the squares comprising the grip pattern 25. Also, the grid may be partially recessed in the surface of the board 16 so that balls may roll across a ball already in one of the squares, up the incline 22 and back down to enter an empty square.

In both of the board games, a backstop 16A may be added to prevent balls from rolling beyond the back of the board. These balls will then fall through apertures 16B and collect in one location below the board for easy recovery at the end of the players's turn.

It has also been found that the use of these balls and the boards associated therewith are particularly applicable for use with mentally handicapped people such as retardates. Furthermore, they can be used by young children, not only for pleasure but also for educational purposes.

As an example, the board illustrated in the drawings in FIGS. 5 through 8 may be provided with a magnetized layer 29 at least in the area enclosed by the outer ring 20 insofar as the board of FIGS. 5 and 6 is concerned and within the rectangle 25 shown in FIGS. 7 and 8.

By utilizing a magnetizable material such as steel shot, iron filings, either alone or within a liquid, or the like, the balls may be rolled or pitched towards the board and will tend to adhere once they strike the playing surface within the boundaries hereinbefore described. Other numbers such as those indicated by reference character 30 may be permanently or detachably placed within the rings of the board in FIGS. 5 and 6 and may take the form of flexible magnetized discs or the like and a variety of numbers and/or letters exemplified by those shown in FIGS. 9, 10 and 11, may be temporarily affixed within the squares of the board illustrated in FIGS. 7 and 8. This enables the players, particularly small children, to advance their education while playing a "fun" type game. The magnetized portion of the boards may be accomplished by many ways, but one of the best ways known to applicant is by use of the flexible magnetized plastic sheet material readily available and manufactured by 3M Company.

Figures 9, 10, 11, 12:
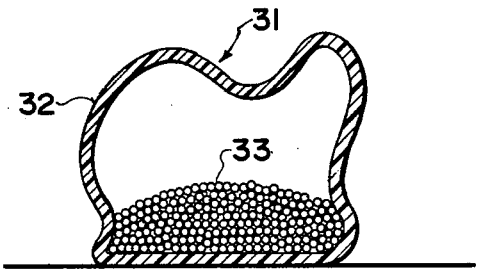
FIGS. 9, 10 and 11 are schematic plan views of a naughts and crosses type board to which numbers, letters or the like may be attached either permanently or detachably for educational purposes.
FIG. 12 is a cross sectional view of a plastic or fabric bag type ball with shot or steel balls therein.

FIG. 12 shows a bag-type ball 31 which is particularly suitable for use with the magnetized boards hereinabove described. It may consist of a flexible bag of plastic or fabric identified by reference character 32 containing a plurality of small spherical steel balls 33 or alternatively, iron filings either dry or suspended within a liquid such as oil or the like thus making the bag-type ball 31, magnetically attractable so that it will tend to adhere to the magnetized portion of the boards.

In all cases, the weighted element 11, 12 or 33 movably shifts the centre of gravity of the ball from the centre thereof to the surface and effects the operating characteristics of the ball, depending upon the construction thereof and the method of use.

Referring back to the numbers 30 illustrated in FIG. 5, upon the crokinole board, the following numbering and/or lettering are examples of the type of detachable labelling that can be utilized:

$$m = \frac{\text{stress}_i}{(\alpha_i - 1/\alpha_i^2)}, \text{ where } \alpha_i = \frac{\text{test length}_i}{\text{gage length}_i}$$

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A combination for playing a game comprising a ball having an outer flexible resilient enclosing envelope and a comminuted material inside the envelope which is free to move within the envelope, and a target board having a front edge and an upper surface and including means for supporting the board such that the front edge thereof can rest upon the ground with the upper surface inclined upwardly away from said front edge, a plurality of dividers extending upwardly from said upper surface to both the transverse and lengthwise directions of the board to define a plurality of compartments each adapted to receive said ball whereby the ball can roll from the ground onto said board to enter one of said compartments.

2. A combination according to claim 1 wherein the board includes a first section on which said dividers are mounted and a second section inclined at a steeper angle than the first section and positioned on the opposite side of said first section relative to said front edge.

3. A combination according to claim 1 wherein the edge of the board opposite said front edge includes a stop member extending across said edge to prevent the ball passing over the edge.

4. A combination according to claim 1 wherein the board includes an opening parallel to said front edge and on the side of said dividers opposite to said front edge the opening being arranged such that the ball can pass therethrough to the underside of the board.

5. A combination according to claim 3 including an opening immediately adjacent said stop member, parallel thereto and extending across the board whereby the ball after hitting the stop member passes through the opening to the underside of the board.

6. A combination according to claim 1 wherein the dividers and ball are arranged such that a further ball rolling on said board and engaging a ball in a compartment rolls over said ball to enter a further compartment.

7. A combination according to claim 1 in which said comminuted material is in a liquid.

8. A combination according to claim 1 in which said comminuted material comprises lead shot.

9. A combination according to claim 1 in which said comminuted material comprises steel balls.

10. A combination according to claim 1 wherein said board at least within the area defined by said dividers, is magnetic, said comminuted material of said ball being magnetically attractable.

11. A combination according to claim 1 in which said ball includes a plurality of substantially equally spaced and distributed obstacles extending inwardly from the inner surface of said envelope and assisting in the control of the movement of said ball.

* * * * *